US012188187B2

(12) United States Patent
Iliev

(10) Patent No.: US 12,188,187 B2
(45) Date of Patent: Jan. 7, 2025

(54) GUIDE PLATE AND RAIL ATTACHMENT POINT

(71) Applicant: Vossloh Fastening Systems GmbH, Werdohl (DE)

(72) Inventor: Dimitre Iliev, Munich (DE)

(73) Assignee: Vossloh Fastening Systems GmbH, Werdohl (DE)

( * ) Notice: Subject to any disclaimer, the term of this patent is extended or adjusted under 35 U.S.C. 154(b) by 860 days.

(21) Appl. No.: 17/275,954

(22) PCT Filed: Sep. 9, 2019

(86) PCT No.: PCT/EP2019/073988
§ 371 (c)(1),
(2) Date: Mar. 12, 2021

(87) PCT Pub. No.: WO2020/053145
PCT Pub. Date: Mar. 19, 2020

(65) Prior Publication Data

US 2022/0106741 A1 Apr. 7, 2022

(30) Foreign Application Priority Data

Sep. 13, 2018 (DE) ..... 10 2018 122 426.5

(51) Int. Cl.
*E01B 9/28* (2006.01)
*E01B 9/00* (2006.01)
(Continued)

(52) U.S. Cl.
CPC ..... *E01B 9/28* (2013.01); *E01B 9/00* (2013.01); *E01B 9/02* (2013.01); *E01B 9/30* (2013.01);
(Continued)

(58) Field of Classification Search
CPC ..... E01B 9/28; E01B 9/02; E01B 9/00; E01B 9/62; E01B 9/64; E01B 9/66; E01B 9/68;
(Continued)

(56) References Cited

U.S. PATENT DOCUMENTS 1,018,247 A 2/1912 Laeufer
6,305,613 B1 10/2001 Igwemezie
(Continued)

FOREIGN PATENT DOCUMENTS

CA 1159805 A * 1/1984
CN 203007738 U 6/2013
(Continued)

*Primary Examiner* — Zachary L Kuhfuss
*Assistant Examiner* — James William Jones
(74) *Attorney, Agent, or Firm* — The Webb Law Firm

(57) ABSTRACT

The invention relates to a guide plate for laterally guiding a rail in a rail attachment point formed on a railroad tie, wherein the guide plate has a top side having a support surface for supporting a spring element, an underside, by way of which the guide plate is supported on the railroad tie during use, a support segment having a support surface, by way of which the guide plate is supported, during use, on a shoulder provided on the railroad tie, and possesses a guide segment which is formed opposite to the support segment, and on which a guide surface is present, on which a rail is laterally guided during use. In order to counteract twisting of the rail and concomitantly the risk of the occurrence of track warping at high outdoor temperatures when using such a guide plate in a rail attachment point, a latch projection is formed in lateral end segments of the guide surface, in each instance, projecting away from the guide surface in the longitudinal direction of the guide plate, which is provided for the purpose of engaging, during use, under the longitudinal side of the rail that is assigned to the guide surface, in each instance, wherein the distance between the latch pro-
(Continued)

jections amounts to at least 60% of the width of the guide surface.

14 Claims, 4 Drawing Sheets

(51) Int. Cl.

| | |
|---|---|
| ***E01B 9/02*** | (2006.01) |
| ***E01B 9/30*** | (2006.01) |
| ***E01B 9/36*** | (2006.01) |
| ***E01B 9/48*** | (2006.01) |
| ***E01B 9/62*** | (2006.01) |
| *E01B 9/64* | (2006.01) |
| *E01B 9/66* | (2006.01) |
| *E01B 9/68* | (2006.01) |

(52) U.S. Cl.
CPC ..... *E01B 9/303* (2013.01); *E01B 9/36* (2013.01); *E01B 9/48* (2013.01); *E01B 9/483* (2013.01); *E01B 9/62* (2013.01); *E01B 9/64* (2013.01); *E01B 9/66* (2013.01); *E01B 9/68* (2013.01)

(58) Field of Classification Search
CPC ... E01B 9/30; E01B 9/303; E01B 9/36; E01B 9/48; E01B 9/483
USPC ..... 238/297
See application file for complete search history.

(56) References Cited

U.S. PATENT DOCUMENTS

| | | | | |
|---|---|---|---|---|
| 8,052,068 | B1 * | 11/2011 | Renneckendorf ..... | E01B 9/303 238/349 |
| 9,523,174 | B2 | 12/2016 | Bosterling et al. | |
| 10,174,459 | B2 | 1/2019 | Mießbacher et al. | |
| 2011/0272485 | A1 | 11/2011 | Renneckendorf et al. | |
| 2012/0111959 | A1 * | 5/2012 | Krieg ..... | E01B 9/303 238/349 |
| 2012/0111960 | A1 * | 5/2012 | Bosterling ..... | E01B 9/303 238/349 |
| 2015/0129670 | A1 | 5/2015 | Krieg et al. | |

FOREIGN PATENT DOCUMENTS

| | | | | | |
|---|---|---|---|---|---|
| CN | 203174444 | U | | 9/2013 | |
| CN | 104379837 | A | | 2/2015 | |
| CN | 105074087 | A | | 11/2015 | |
| CN | 204753268 | U | | 11/2015 | |
| CN | 106062277 | A | | 10/2016 | |
| CN | 206219901 | U | | 6/2017 | |
| DE | 3423997 | A1 | | 1/1986 | |
| DE | 10254679 | B4 | | 10/2007 | |
| DE | 202011104743 | U1 | | 3/2012 | |
| DE | 102013007306 | A1 | * | 10/2014 | ..... E01B 9/42 |
| DE | 202014105818 | U1 | * | 3/2015 | ..... E01B 9/00 |
| EP | 3269877 | A1 | * | 1/2018 | ..... E01B 9/68 |
| EP | 3293308 | A1 | * | 3/2018 | ..... E01B 3/32 |
| GB | 2552817 | A | * | 2/2018 | ..... E01B 9/02 |
| RU | 179449 | U1 | | 5/2018 | |
| WO | WO-2017215757 | A1 | * | 12/2017 | ..... E01B 9/38 |

* cited by examiner

GUIDE PLATE AND RAIL ATTACHMENT POINT

CROSS-REFERENCE TO RELATED APPLICATIONS

This application is the United States national phase of International Application No. PCT/EP2019/073988 filed Sep. 9, 2019, and claims priority to German Patent Application No. 10 2018 122 426.5 filed Sep. 13, 2018, the disclosures of which are hereby incorporated by reference in their entirety.

BACKGROUND OF THE INVENTION

Field of the Invention

The invention relates to a guide plate for laterally guiding a rail in a rail attachment point formed on a railroad tie. In this regard, the guide plate possesses a top side, on which a support surface for supporting a spring element is formed. Furthermore, such a guide plate has an underside, by way of which the guide plate is supported on the railroad tie during use. Furthermore, a support surface is present on an end face of a support segment of the guide plate, by way of which surface the guide plate is supported, during use, on a shoulder provided on the railroad tie. Finally, the guide plate also has a guide segment, which is formed in the longitudinal direction of the guide plate, opposite to the support segment, and on the end face of which a guide surface is present, on which a longitudinal side of the rail is supported during use, so as to guide the rail laterally, wherein the guide surface makes contact with one of the longitudinal side surfaces with its narrow sides in a corner region, in each instance, which surfaces delimit the guide plate on its longitudinal sides.

Description of Related Art

Such guide plates are known in various embodiments, for example from DE 102 54 679 B4. Supplementally, reference is made to guide plates according to DE 34 23 997 A1, DE 20 2011 104 743 U1 or U.S. Pat. No. 6,305,613 B1.

The rail attachment point in which the guide plate is used is usually set up on the top side of a block-shaped railroad tie, on which a contact surface for the rail is provided, which surface is delimited laterally, in the longitudinal direction of the railroad tie, by means of a support shoulder, in each instance.

Rail attachment points in which rails for rail vehicles are attached to a railroad tie, as well as the components required for their production are in use in the millions in practice. In this regard, in a rail attachment point a guide plate is generally arranged, in each instance, on each longitudinal side of the rail to be attached. The guide plates not only ensure that the rail maintains its required position in the track when a rail vehicle passes over it, but furthermore also serve as a contact point for a spring element, in each instance, which is biased against the railroad tie that carries the rail and exerts an elastic hold-down force on the longitudinal side segment of the rail foot assigned to the guide plate, in each instance, by means of which force the rail is held on the railroad tie.

The support shoulders are provided on the railroad tie in order to conduct away the transverse forces that act against the guide plate into the railroad tie during travel on the rail held in the corresponding rail attachment point. The corresponding guide plate is supported against one of these shoulders on its side opposite to the rail. Precise positioning and support of the guide plate can be supported in that a guide segment that is angle-shaped in a side view is formed on the underside of the guide plate, typically in the region of the transition to the support surface of the guide plate that lies against the support shoulder, which segment engages into a groove formed in the railroad tie, extending in the width direction of the railroad tie. Guide plates formed in this manner are referred to as "angle guide plates" in technical language.

The railroad ties on which the corresponding rail is fixed in place, which as such are part of the corresponding rail attachment points, usually carry two rails that run parallel to one another and together form a track on which a rail vehicle runs with its rail wheels. In this manner, the railroad ties form the directionally stable progression of the rails of a track, and distribute the loads that occur when a rail vehicle passes over the rails to the substructure that carries the railroad ties. This substructure is usually formed as a ballast bed in the case of conventional track systems, on which or in which the railroad ties lie loosely.

For a long time, the rails in track systems, which are unavoidably composed of separate individual parts for reasons of production technology, have been welded throughout. In this way, what are called "rail gaps" between the end faces of the pieces that are assigned to one another are prevented. However, rigid welding has the result that the rails cannot expand so as to compensate the consequences of their heat expansion, which accompanies heating. This leads to the formation of great axial pressure forces in the rails, in particular during the summer months. If these forces become too great, the track bends out laterally in certain places. In the case of such track warping, the railroad ties are typically displaced by 10-50 cm laterally as compared with their proper orientation. At the same time, twisting of the rails in the rail contact surface of the railroad tie takes place. As a result of the warping and twisting, the guide plate is subjected to great stresses, which can go so far that the guide plate is no longer in the position required for its function. As a result, travel over a bent route segment is only possible with great caution or actually not possible at all.

It is known that thermally caused track warping can be counteracted by means of lateral reinforcement of the track grid that is formed by the railroad ties and the rails. Thus, the tendency to bend can be reduced by means of the use of specially shaped railroad ties that guarantee particularly great resistance to lateral deformations of the track, called "Y steel railroad ties." Also, the danger of the formation of track warping can be counteracted by increasing the transverse displacement resistance of the railroad ties. For this purpose, particularly heavy concrete railroad ties, for example, or railroad tie anchors that engage into the ballast bed are used. Also, the friction resistance between ballast bed and railroad tie can be increased by means of corresponding coatings on the railroad tie or design measures such as special profiling of the railroad tie flanks.

Proceeding from the state of the art as explained above, the task has arisen of configuring a guide plate in such a manner that when used in a rail attachment point, it counteracts twisting of the rail with optimal resistance, and thereby at the same time counteracts the risk of the occurrence of track warping that occurs at high outdoor temperatures.

Likewise, a rail attachment point is supposed to be indicated, in which, in the same manner, optimized resistance counteracts twisting of the rail and the risk of track warping that occurs along with it at high outdoor temperatures.

SUMMARY OF THE INVENTION

With reference to the guide plate, the invention has accomplished this task by means of a guide plate having at least the characteristics as described herein.

A rail attachment point that accomplishes the task stated above has at least the characteristics as described herein.

Advantageous embodiments of the invention are indicated in the dependent claims and will be explained in detail below, along with the general idea of the invention.

In agreement with the state of the art as explained initially, a guide plate for laterally guiding a rail in a rail attachment point formed on a railroad tie possesses:

- a top side on which a support surface for supporting a spring element is formed,
- an underside by way of which the guide plate is supported on the railroad tie during use,
- a support segment that has a support surface on its end face, by way of which surface the guide plate is supported, during use, on a shoulder provided on the railroad tie, and
- a guide segment that is formed in the longitudinal direction of the guide plate, opposite to the support segment, and at the end face of which a guide surface is present, on which a longitudinal side of the rail is supported during use, so as to guide the rail laterally, wherein the guide surface makes contact, with its narrow sides, with one of the longitudinal side surfaces that delimit the guide plate on its longitudinal sides, in a corner region, in each instance.

According to the invention, in the case of such a guide plate, a latch projection that projects away from the guide surface in the longitudinal direction of the guide plate, in each instance, is now formed in end segments of the guide surface that border on the corner regions, in each instance, which projection is intended for engaging under the longitudinal side of the rail that is assigned to the guide surface during use, in each instance, wherein in the width direction of the guide plate, the distance between the latch projections amounts to at least 70%, in particular at least 80% of the width of the guide surface.

A rail attachment point according to the invention comprises, in corresponding manner

- a railroad tie that has a top side and two longitudinal sides, which come together with the top side of the railroad tie in a longitudinal edge, in each instance, wherein a rail held in the rail attachment point is supported on a contact surface provided on the top side of the railroad tie, and wherein the railroad tie is oriented transverse to the rail and has a width measured in the direction of the longitudinal expanse of the rail, and
- a guide plate formed in accordance with the invention, attached to the railroad tie, which plate is supported, by way of its support surface, on a shoulder provided on the railroad tie, and on the guide surface of which plate the rail is guided with one of its longitudinal sides, under which the latch projections engage.

In the case of a guide plate according to the invention, latch projections that project in the manner of lugs are thereby formed on the end face having the guide surface, in the region of the end segments of the guide surface, which projections engage under the longitudinal side of the rail assigned to the guide surface of the guide plate, in each instance, during use of a guide plate according to the invention in a rail attachment point. In this manner, shape-fit support of the rail on the guide plate, acting in the direction of gravity, is produced in the rail attachment point, by means of which support it is ensured that planar contact is maintained between the guide segment of the guide plate and the related longitudinal side of the rail foot.

In this way, the latch projections prevent the end segments of the guide surface of the guide plate from being lifted up during installation of the guide plate. At the same time, after installation they ensure, in the event that the rail is twisted, that the guide plate is subjected to stress uniformly and that great rigidity counteracts deformation of the rail, so that great resistance to twisting of the rail as the result of great heating is guaranteed.

With regard to the effect of the latch projections, it has proven to be important that these are formed only in the corner regions of the guide surface, and that a section without a projection that engages under the rail during use is present between them. In this way, in a rail attachment point according to the invention, it is guaranteed that the rail is supported on the railroad tie, even between the latch projections, over a long stretch without material of the guide plate that lies in between. In this regard, the lever effect during support of the rail is optimally utilized by means of arranging the latch projections spaced apart as much as possible.

Accordingly, a particularly practice-oriented embodiment of the invention provides that the latch projections border on the corner region assigned to them, in each instance, in which the guide surfaces make contact with a longitudinal side surface of the guide plate, in each instance.

Likewise, it is advantageous, for the reasons explained above, if the latch projections extend at most over the width of the end segment of the guide surface assigned to them, in each instance, so that a sufficiently great distance remains clear between the latch projections.

For example, a guide plate shaped as a rectangle, in conventional manner, in a top view of its top side, can be equipped with the latch projections configured and arranged according to the invention on its guide surface, so as to bring about increased resistance to twisting of the rail in a rail attachment point that is equipped with it.

With regard to material utilization and shape stability of a guide plate according to the invention, it has proven to be advantageous if the guide surface of the guide segment has a greater width than the support surface of the support segment, so that in the case of a projection of the support surface into the guide surface, the guide surface projects laterally beyond the support surface with the end segments in which the latch projections are formed. In this embodiment, the support segment that carries the support surface is narrower than the guide segment of the guide plate that carries the guide surface.

The basic shape of a guide plate formed in this manner is then the same as that of the known guide plates shown in the German patent DE 102 54 679 B4, FIGS. 3*a*-4*d*. However, there it has not been recognized that the resistance to twisting of the guide plate in a rail attachment point can be effectively increased by means of widening of the guide segment, in particular widening going as far as the railroad tie width or beyond, and the accompanying widening of the guide surface of a guide plate, in combination with the locking projections formed on the guide surface, according to the invention.

Optimized geometric conditions occur with regard to optimal load-bearing capacity, with simultaneously minimized volume and therefore a minimized material requirement for shaping the guide plate, if the following applies for the ratio BF/BS of the width BF of the guide surface to the width BS of the support surface of the guide plate:

$1.2 \leq BF/BS \leq 1.6$, wherein ratios BF/BS of at least 1.3 or at least 1.4 or at most 1.5 have proven to be particularly practice-oriented.

Such guide plates, structured according to the invention, demonstrate a resistance to twisting as the result of longitudinal expansion of the rail at elevated outdoor temperatures that is increased three to six times as compared with conventional guide plates, for example of the type shown in DE 102 54 679 B4.

In order to achieve optimally great resistance to twisting at minimized weight and material volume, in a guide plate according to the invention the guide segment can also be widened in width so that a guide surface carried by the guide segment has a width that goes beyond the width of the support surface of the guide plate. This makes it possible to support the rail foot laterally on the corresponding guide plate over a clearly greater length in a rail attachment point equipped with a guide plate structured according to the invention than is the case in a conventional rail attachment point.

In this regard, a width of the guide segment of the guide plate that goes beyond the contact surface of the railroad tie has the advantage that the locking projections then arranged in the end segments that project laterally beyond the railroad tie can still engage under the longitudinal side of the rail assigned to the guide plate without problems, even if the rail sits on the railroad tie directly, i.e. without a plate element arranged between rail and railroad tie. In the case that the width of the guide surface is less than or equal to the width of the contact surface of the railroad tie, at least one intermediate plate can be arranged between the rail and the railroad tie, by means of which plate the rail is held at a height distance above the contact surface of the railroad tie, which distance is at least equal to the height of the latch projections, so that the latch projections can engage under the longitudinal side of the rail assigned to them. In this regard, two or more plates that are laid one on top of the other to form a stack can also be used in place of an intermediate plate, so as to adjust a suitable height position.

By means of the larger contact zone between the longitudinal side of the rail foot and the guide surface of the guide plate that lies against it, for one thing the push-through resistance, in other words the resistance to a relative movement between rail and guide plate that takes place in the longitudinal direction of the rail, is increased. At the same time, a clearly increased lever effect is available at the guide plate, with reference to a vertical axis oriented in the height direction of the rail, as compared with conventional guide plates, by way of which effect the guide plate can counteract twisting of the rail about the vertical axis in question, caused by thermal expansion of the rail.

In that according to the invention, two latch projections are provided on the end face, which has the guide surface, of a guide plate according to the invention, in the region of the end segments with which the guide surface projects beyond the support surface in the case of projection of the support surface into the guide surface, in a vertical plane, a shape-fit barrier that acts in the direction of gravity is formed in a rail attachment point structured according to the invention, which barrier prevents relative movement between rail and guide plate in the direction of gravity. In this manner, it is ensured that the planar contact between the guide segment of the guide plate and the assigned longitudinal side of the rail foot is guaranteed.

In this regard, the latch projections provided according to the invention also prevent the end segments of the guide surface, which are advantageously present on a guide segment that is widened in the manner described above, as compared with the support segment, from being lifted up during installation of the guide plate.

At the same time, the latch projections ensure, in the event that the rail twists, that the guide plate is subject to uniform stress and that great rigidity counteracts deformation of the rail, so that great resistance to twisting of the rail as the result of great heating is guaranteed.

In the end result, in this way the structure of a guide plate according to the invention counteracts the risk of track warping and lasting impairment of the function of the rail attachment point, which risk exists in the state of the art as the result of heat expansion of the rails.

In this regard, the particular advantage of a structure of a guide plate according to the invention consists in that the conventional guide plates installed in the field can be replaced with guide plates according to the invention on track routes on which the risk of track warping exists, using simple means. All the other components of the rail attachment point already present in the field can continue to be used, so that existing routes that are at risk with regard to the formation of warping can be made safer by using guide plates according to the invention, in a resource-saving and particularly efficient manner, according to the invention.

Fundamentally, the guide plate structured according to the invention can be fixed in place on the railroad tie in any known manner, so as to absorb the forces that act on it during use and to conduct them away into the railroad tie. It has proven to be particularly advantageous for this purpose if the guide plate has a support segment, in known manner, on its side that lies opposite the guide segment, and this support segment has a support surface on its end face, which surface is supported against a shoulder provided on the railroad tie, and the width of which surface is smaller than the width of the guide surface.

In the event that the guide plate is provided with a support segment in the manner mentioned in the preceding paragraph, the width of the support segment on its end face that carries the support surface is advantageously at most equal to the width of the shoulder in its region that comes into contact with the support surface. In this way, optimal support at the shoulder of the railroad tie provided for this purpose is achieved with minimized use of material for shaping the guide plate.

In accordance with a particularly practice-oriented embodiment, which guarantees uniform support of the rail in the case of uniform stress on the guide plate, a guide plate structured according to the invention is shaped in known manner, such as, for example, the guide plates known from DE 102 54 679 B4, which was mentioned above, with mirror symmetry, seen in a top view, with reference to its longitudinal axis that is oriented transverse to the longitudinal expanse of the rail. This proves to be particularly practical if the guide plate according to the invention is supposed to be used in a rail attachment point that is configured conventionally otherwise, in which a spring element configured as a W-shaped rail clamp is set onto the guide plate, as is also shown in DE 102 54 679 B4, for example, and used in the field in the millions.

Temporary changes in the height position of the rail can occur, for example, as the result of elastic sinking of the rail when a rail vehicle travels over the corresponding rail attachment points, or as the result of twisting of the rail about its longitudinal axis that accompanies heat expansion that occurs at high outdoor temperatures.

An optimal effect of the latch projections occurs, in this regard, when the underside of the latch projections makes contact with the lower delimitation edge of the end face of the guide plate that has the guide surface, and the height of the latch projections is equal to at most half the height, in particular equal to at most a third of the height of the guide surface.

In order to prevent overloading of the latch projections in the event of a greater sinking movement, which can be caused when a particularly heavy rail vehicle travels over the rail attachment points, the latch projections can have a slanted surface on their top side, on which surface the rail foot is supported, and which drops in the direction of the free end face of the latch projections. Here, it has particularly proven itself that the slanted surface encloses an inclination angle of at most 45° with a plumb line dropped to the guide surface, wherein inclination angles of 40°+/−2° have proven to be particularly practical, so as to prevent overloading of the latch projections.

The resistance exerted by a guide plate structured according to the invention in a rail attachment point to counteract its twisting about a vertical axis oriented in the height direction of the rail can additionally be increased by means of suitable stiffening of the guide plate. For this purpose, a guide plate according to the invention can have a reinforcement rib in a region of its top side that borders on the end face provided with the guide surface, which rib extends over the width of the guide surface.

It serves the same purpose if, in the case of a guide plate structured according to the invention, a stiffening rib is formed on its top side, in each instance, in the edge region of those side segments that connect the guide segment with the support segment. By means of such lateral stiffening, the guide plate is optimally stiff in its lateral edge region, in which the greatest stresses can occur during use.

Optimal shape rigidity of the guide plate as a whole occurs, in this regard, if the reinforcement rib and the stiffening ribs are present, and the stiffening ribs support the reinforcement rib at the end, in each instance, that is assigned to them. For this purpose, the reinforcement ribs can make a transition into one of the stiffening ribs, in each instance, at their lateral ends.

All of the embodiments of a guide plate according to the invention explained above and resulting from the claims, and, accompanying this, of a rail attachment point equipped with such a guide plate, according to the invention, can be used in particularly advantageous manner, in particular, if the guide plate is formed in one piece from a plastic material. Possible plastic materials, in this regard, are those that are already now being used for production of guide plates of the type in question here.

Particularly effective support of the rail in a rail attachment point according to the invention can be achieved in that the guide plate structured according to the invention is formed in the manner of an angle guide plate. In this embodiment, the angle-shaped step, which is provided on the underside of the guide plate structured according to the invention and extends in the width direction of the guide plate engages, in this case, into a groove correspondingly formed in the top side of the railroad tie, and thereby increases the size of the region in which the guide plate is supported on the railroad tie.

BRIEF DESCRIPTION OF THE DRAWINGS

In the following, the invention will be explained in greater detail using a drawing that shows an exemplary embodiment. The figures schematically show, in each instance.

DESCRIPTION OF THE INVENTION

Figure 1:
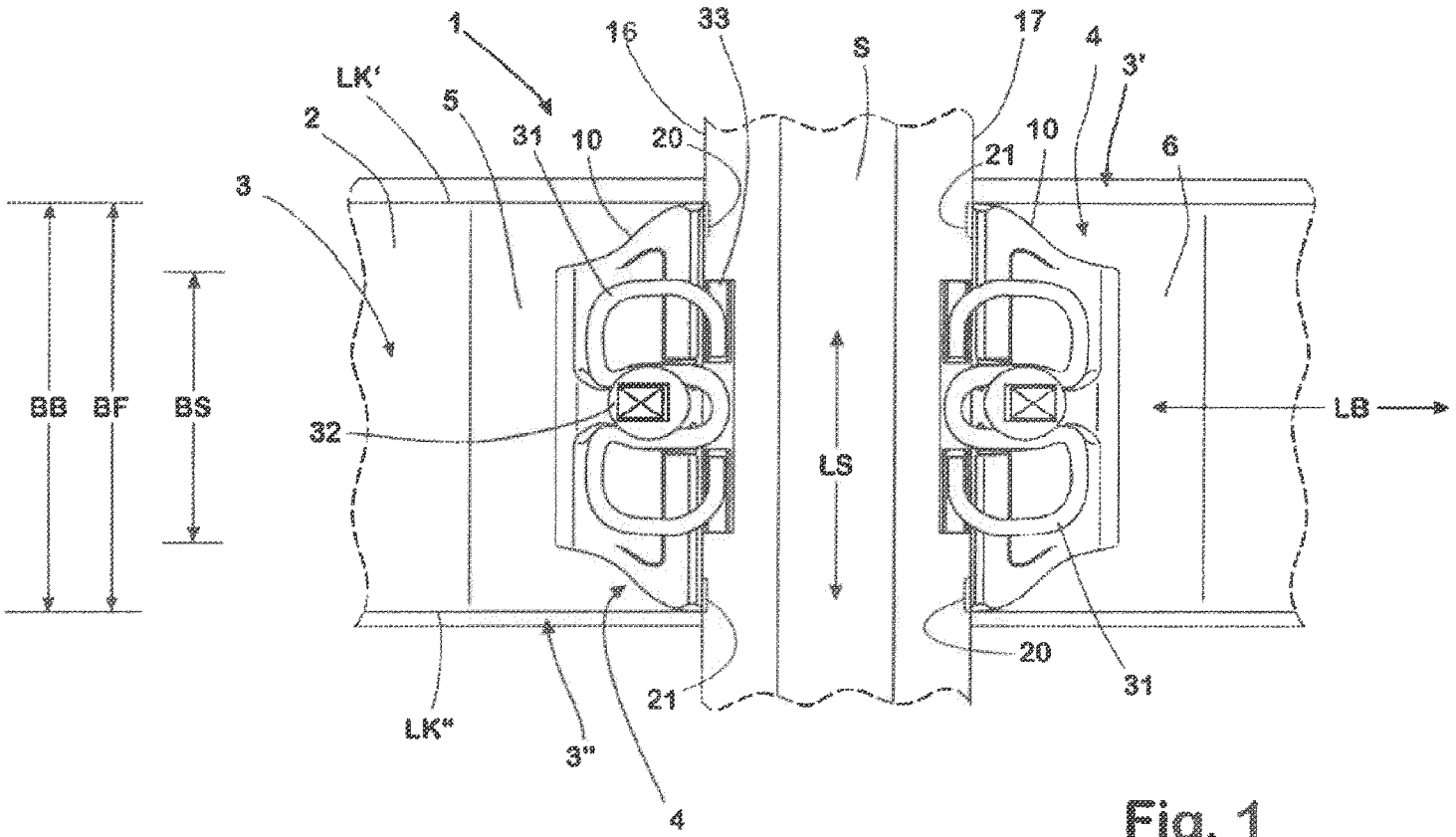
FIG. 1 a rail attachment point in a view from above.
Figure 2:
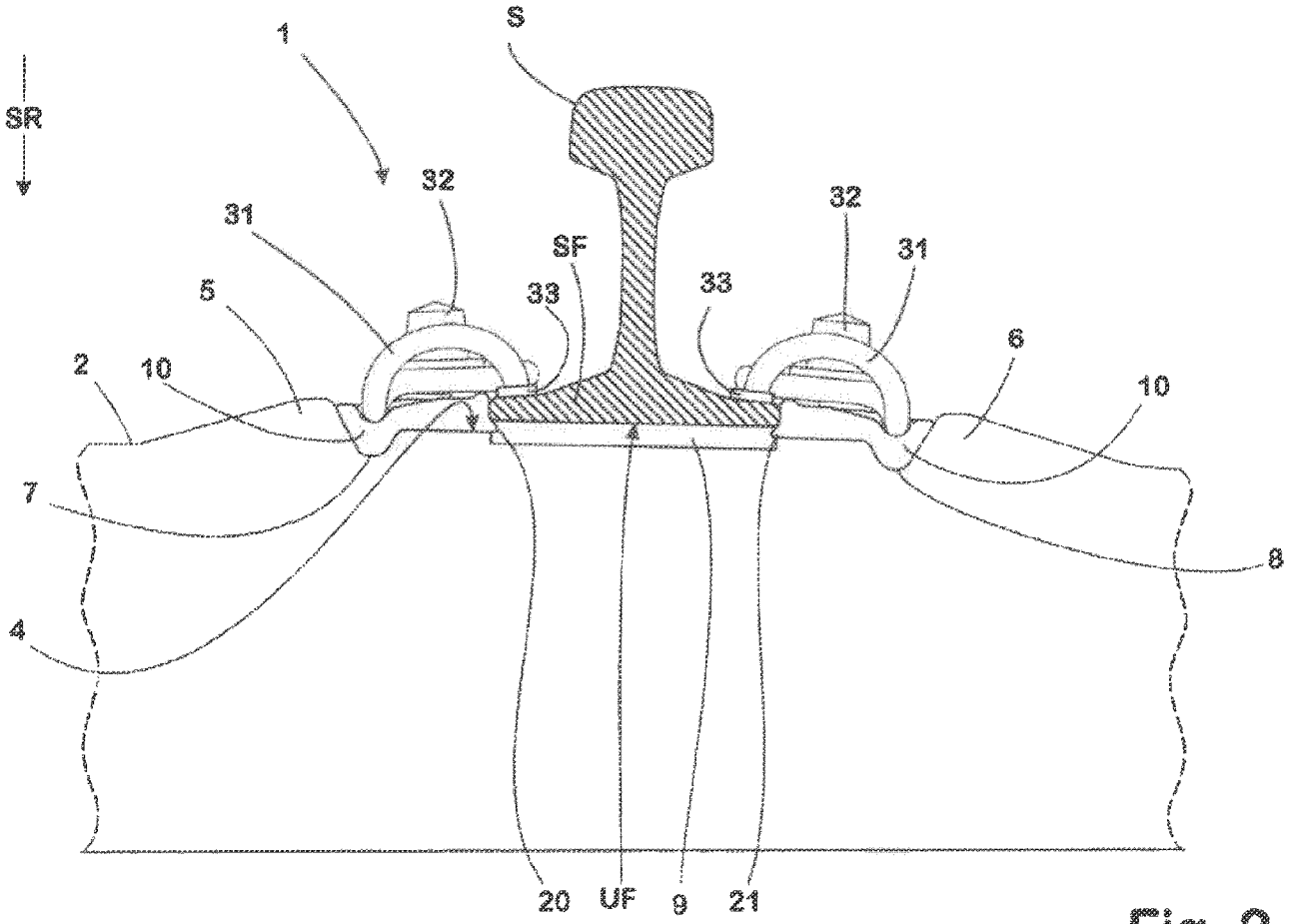
FIG. 2 the rail attachment point in a side view.

A rail S is attached in the rail attachment point 1, which rail is part of a track for rail vehicles, not shown here, in which usually two rails S are guided in parallel. The rail attachment points 1 provided for attachment of the rails S of the track are configured in the manner of the rail attachment points 1 in a route segment that tends toward track warping at high outdoor temperatures, while in the other route segments, conventionally structured rail attachment points of the general type indicated initially can be used.

The rail attachment point 1 comprises a railroad tie 2 oriented transverse to the longitudinal expanse LS of the rail S, at the one end segment of which railroad tie the rail attachment point 1 is set up. At the opposite end segment, not shown here, the second rail of the track, to which the rail S attached in the rail attachment point 1 belongs, is attached in the same manner.

The block-shaped railroad tie 2, which is conventionally shaped, in total, is produced from a concrete material, in known manner, and is mounted in a ballast bed, not shown here, also in known manner. In this regard, the railroad tie 2 has a top side 3 and two longitudinal sides 3', 3", which come together with the top side 3, in each instance, in a longitudinal edge LK', LK".

On the top side 3 of the railroad tie 2, a contact surface 4 is formed, on which the components of the rail attachment point 1 sit. In the longitudinal direction LB of the railroad tie 2, which is oriented transverse to the longitudinal expanse LS of the rail S, the contact surface 4 is delimited, in each instance, by a shoulder 5, 6, which has a planar support surface 13, inclined relative to the vertical, proceeding from the contact surface 4, on its end face assigned to the contact surface 4, in each instance. In the edge regions of the contact surface 4 that come together with the corresponding shoulder 5, 6, in each instance, a groove 7, 8 is formed, in each instance, which groove extends over the width BB of the contact surface 4 of the railroad tie 2, measured transverse to the longitudinal expanse LS.

The rail S stands, with the underside UF of its rail foot SF, on an elastic intermediate layer 9, which is embedded in the contact surface 4 of the railroad tie 2 in the center between the shoulders 5, 6. In this way, the rail S is supported in elastically resilient manner on the railroad tie 2, in the direction of gravity SR, in known manner.

The rail attachment point 1 furthermore comprises two guide plates 10, shaped identically in one piece from a plastic material that has proven itself for this purpose, with one of these plates being arranged on one of the longitudinal sides of the rail S, in each instance.

Figure 3:
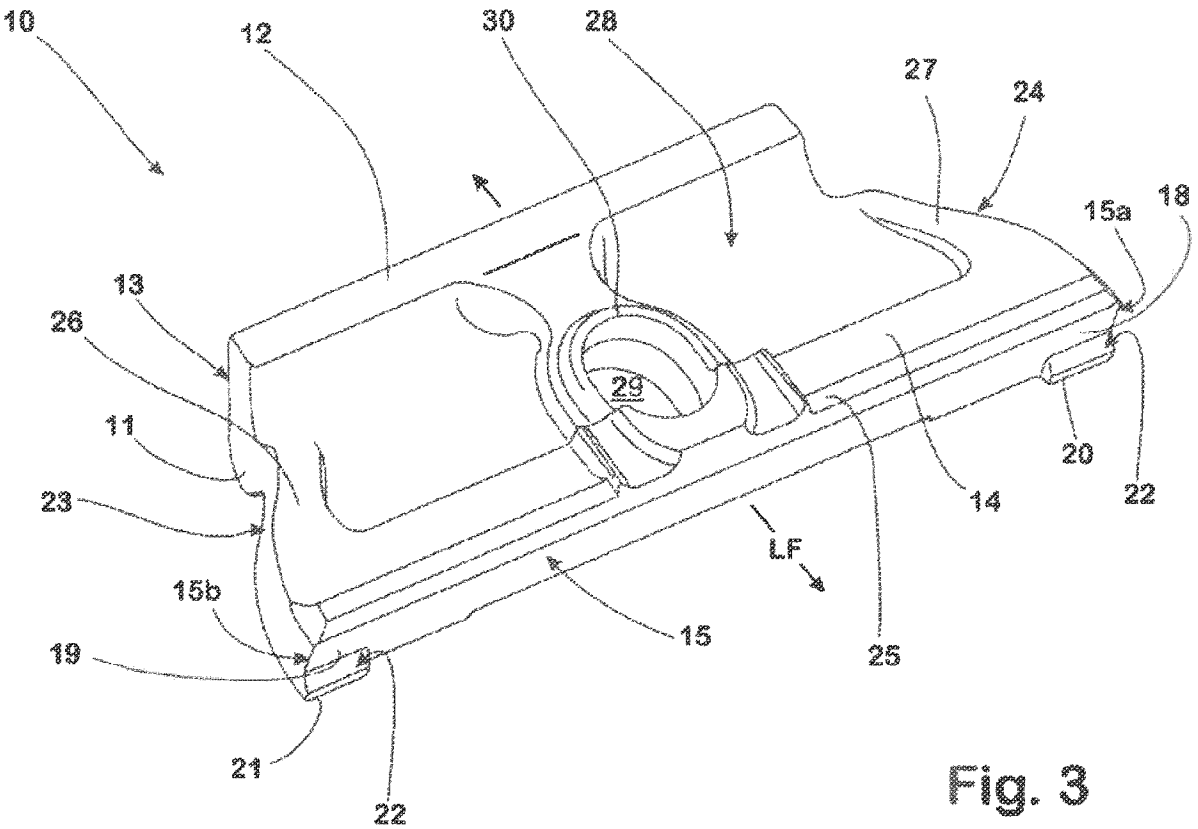
FIG. 3 a guide plate used in the rail attachment point, in a perspective view directed at its top side.
Figure 4:
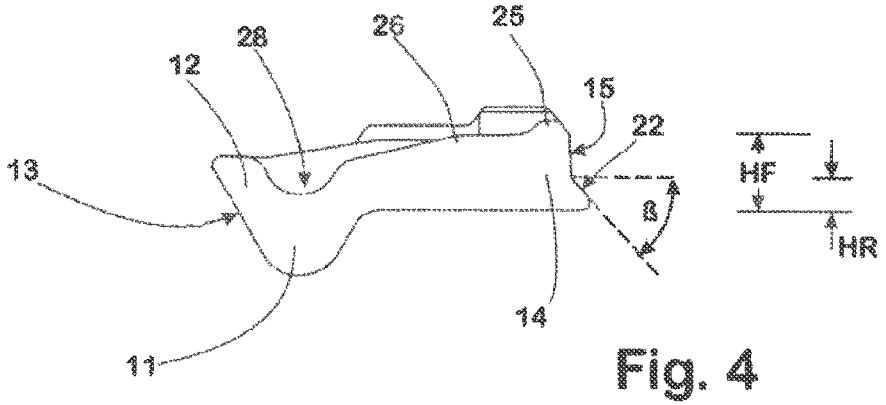
FIG. 4 the guide plate in a side view.
Figure 5:
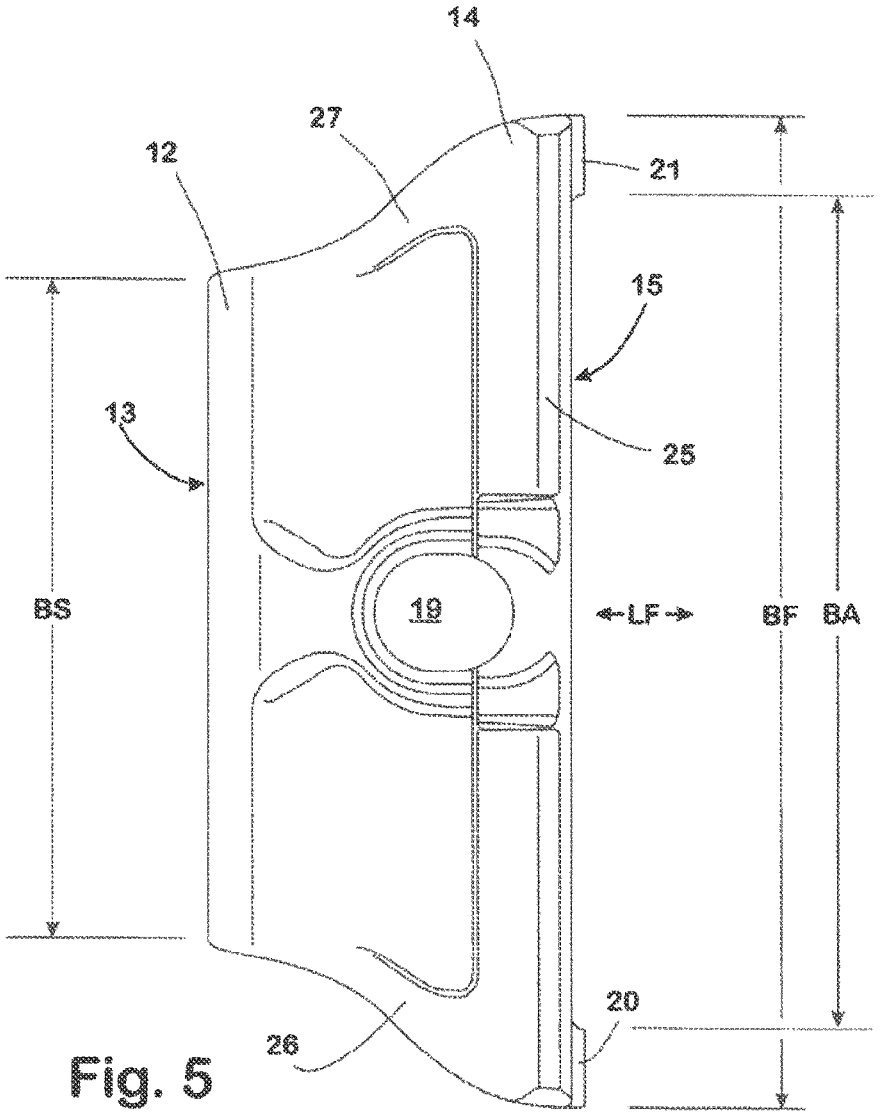
FIG. 5 the guide plate in a view from above.

The guide plates 10, which are formed with mirror symmetry in a top view (FIG. 3), with reference to their longitudinal axis LF that is oriented in axis-parallel manner relative to the longitudinal axis of the railroad tie 2, are configured in the manner of angle guide plates and have an angle-shaped step 11, in a side view, on their underside with which they lie on the contact surface 4 of the railroad tie 2, and with which step they sit in the groove 7, 8 of the railroad tie 2 that is assigned to them, in each instance. In this regard, the step 11 is formed in the region of a support segment 12 of the guide plates 10, by way of which segment the guide plates 10 are supported on the shoulder 5, 6 of the railroad tie 2 assigned to the corresponding guide plate 10, in each instance. For this purpose, the support segment 12 of the guide plates 10 has a support surface 13 that extends over the width of the support segment 12 on its end face assigned to the shoulders 5, 6, which surface is inclined in accordance with the inclination of the support surface of the assigned shoulder 5, 6, so that in the completely installed rail attachment point 1, the support surface 13 of the guide plates 10 lies tightly against the entire support surface of the assigned shoulder 5, 6.

The width BS of the support surface 13, which is the same as the width of the support segment 12, is at most equal to the width BB of the contact surface 4 of the railroad tie, so that the support segment 12 does not project beyond the width of the shoulders 5, 6, but rather its support surface 13 lies against the support surface of the corresponding shoulder 5, 6 with its full area.

On their side facing the rail S, lying opposite the support segment 12, the guide plates 10 have a guide segment 14, in each instance, which carries a planar guide surface 15 on its end face assigned to the rail S, which surface has an elongated rectangular basic shape in the width direction of the guide plate 10.

The rail foot SF lies tightly against the guide surface 15 with its corresponding longitudinal side 16, 17. In this regard, the guide surface 15 makes contact with one of the longitudinal side surfaces present on the longitudinal sides 16, 17 with one of its narrow sides, in a corner region 15*a*, 15*b* of the guide surface 15, in each instance, which surfaces delimit the guide plate 10 outward on its longitudinal sides.

The guide surface 15 extends completely over the end-face width of the guide segment 14. In this regard, its width BF is equal to the width BB of the contact surface 4 of the railroad tie 2, so that the guide surface 15 extends, with its end segments 18, 19, which make contact with the corner regions 15*a*, 15*b*, over the entire width BB of the contact surface 4, in each instance, and thereby concomitantly over the top side 3 of the railroad tie 2 between the longitudinal edges LK', LK". At the same time, the ratio BF/BS of the width BS of the support surface 13 relative to the width BF of the guide surface 15 is BF/BS=1.5.

Adjacent to the corresponding corner region 15*a*, 15*b*, in each instance, a latch projection 20, 21 is formed on the end segments 18, 19 of the guide surface 15 of the guide segment 14, in each instance, which projection projects away perpendicular to the guide segment 14 with reference to the guide surface 15, and is oriented flush with the underside of the guide plates 10 with its underside.

The latch projections 20, 21 are formed, in each instance, in the lower half of the corner regions 15*a*, 15*b* of the guide surface 15 of the guide segment 14. Their maximum height HR corresponds to approximately one third of the maximum height HF of the guide surface 15 in the region between the latch projections 20, 21. In this regard, the height HR and the height HF are dimensioned in such a manner that when the rail attachment point 1 is completely installed, the latch projections 20, 21 engage under the longitudinal side 16, 17 assigned to the corresponding guide plate 10, and thereby act against the underside UF of the rail foot SF. In this regard, the distance BA between the locking projections 20, 21, measured in the width direction, amounts to at least 80% of the entire width BF of the guide surface 15.

On their top side, the latch projections 20, 21 of the guide plates 10 have a slanted surface 22, in each instance, which, proceeding from the edge at which the top side of the corresponding latch projections 20, 21 makes contact with the guide surface 15, drops down in the direction of the free end face of the latch projections 20, 21. The angle 13 enclosed between the slanted surface 22 and a plumb line to the guide surface 15 amounts to about 40°, in each instance, in a side view of the guide plates 10, so that the rail S, which sits on the latch projections 20, 21 with the edge between its corresponding longitudinal side 16, 17 and its underside UF, can slide along the slanted surfaces 22 when a lowering movement directed in the direction of gravity SR occurs.

The guide segment 14 makes a transition at the longitudinal sides of the guide plates 10, in each instance, by way of a reinforced side segment 23, 24, into the support segment 12 of the guide plates 10. The side surfaces of the support segments 23, 24 have a continuous, transition-free progression, and thereby convert the width BF of the guide surface 15 to the width BS of the support surface 13. A reinforcement rib 25 that extends over the width BF of the guide surface 15 is formed on the top side of the guide plates 10, in the region of the transition to the guide surface 15. At its lateral ends, the reinforcement rib 25 makes a transition, in each instance, into a stiffening rib 26, 27, which extends on the top side of the guide plates 10, along the edge region of the corresponding side segment 23, 24, and the height of which decreases in the direction of the support segment 12.

In the region of the support segment 12, a groove 28 that extends over the width of the support segment 12 is formed in the top side of the guide plates 10. Furthermore, a passage opening 29 that leads from the top side to the underside of the guide plates 10 is formed in the guide plate 10 at a central location. In addition, a guide rib 30 that runs in the direction of the support segment 12 is provided on the top side of the guide plates 10, proceeding from the reinforcement rib 25; it is arranged in the center with reference to the width of the guide plates 10 and forms a lateral edge around the passage opening 29.

The groove 28 and the guide rib 30 serve as guide elements, by means of which the orientation of a spring element 31, which is configured as a conventional W-shaped rail clamp and sits on the guide plates 10, in each instance, in the rail attachment point 1 is secured. The spring elements 31 are supported in known manner with their holder arms, on the side of the rail foot SF that is assigned to them, in each instance, and are braced against the railroad tie 2 by means of a conventional railroad tie screw 32, in each instance. For this purpose, the railroad tie screws 32 are passed through the center loop of the spring element 31 and the passage opening 29, in a dowel, not shown here, embedded in the railroad tie 2, in each instance, and are supported against the center loop of the spring element 31 with their screw heads. For electrical insulation, an insulation element 33 known for this purpose from the state of the art can also be arranged between the holder arms of the spring elements 31 and the rail foot SF, in each instance.

If lengthening of the rail S occurs as the result of heat expansion caused by high outdoor temperatures, the guide plates 10 counter a sideways movement of the rail S with a resistance that is clearly increased as compared with conventional guide plates. This resistance is achieved by means of the width of the guide segments 14, which goes as far as the width BB of the contact surface 4 of the railroad tie 2, the correspondingly increased width BF of the guide surface 15, as well as the correspondingly increased lever effect with which the guide plates 10 can act against a lateral force that proceeds from the rail S about a vertical axis set up perpendicular to the contact surface 4. The great resistance to twisting is supported by means of the great rigidity that is guaranteed for the guide plates 10 on the basis of their lateral reinforcement by the stiffening ribs 26, 27. In this regard, the latch projections 20, 21 ensure that proper contact between rail S and guide plates 10 is still guaranteed even if the rail S is strained due to the rail attachment undertaken in the rail attachment point 1, or if the rail S is twisted about its longitudinal axis as the result of heat expansion.

REFERENCE SYMBOLS

1 rail attachment point
2 railroad tie
3 top side of the railroad tie 2
3', 3" longitudinal sides of the railroad tie 2
4 contact surface of the railroad tie 2
5, 6 shoulders of the railroad tie 2
7, 8 grooves of the railroad tie 2
9 elastic intermediate layer
10 guide plates
11 angle-shaped step of the guide plates 10
12 support segment of the guide plates 10
13 support surface of the guide plates 10
14 guide segment of the guide plates 10
15 guide surface of the guide plates 10
15*a*, 15*b* corner regions of the guide surface 15
16, 17 longitudinal sides of the rail foot SF
18, 19 end segments of the guide segment 14 of the guide plates 10
20, 21 latch projections of the guide plates 10
22 slanted surface of the latch projections 20, 21
23, 24 reinforced side segments of the guide plates 10
25 reinforcement rib
26, 27 stiffening ribs
28 groove of the guide plates
29 passage opening of the guide plates 10
30 guide rib
31 spring elements (W-shaped rail clamps)
32 railroad tie screws
33 insulation elements
β angle enclosed between the slanted surface 22 and plumb line to the guide surface 15
BA distance between the latch projections
BB width of the railroad tie 2
BF width of the guide surface 15
BS width of the support surface 13
HR maximum height of the latch projections 20, 21
HF maximum height of the guide surface 15
S rail
SF rail foot of the rail S
SR direction of gravity
LB longitudinal direction of the railroad tie 2
LF longitudinal axis of the guide plates 10
LK', LK" edges between the longitudinal sides 3', 3" and the top side 3 of the railroad tie 2
LS longitudinal expanse of the rail S
UF underside of the rail foot SF

The invention claimed is:

1. A guide plate for laterally guiding a rail in a rail attachment point formed on a railroad tie, wherein the guide plate possesses:

a top side, wherein a support surface for supporting a spring element is formed on, an underside, wherein the guide plate is supported on the railroad tie during use, a support segment, comprising a support surface on an end face of the support segment, wherein the guide plate is supported, during use, on a shoulder of the railroad tie, and a guide segment, the guide segment formed in a longitudinal direction of the guide plate, lying opposite the support segment, and on the end face of which a guide surface is present, on which a longitudinal side of the rail is supported during use, in order to guide the rail laterally, wherein the guide surface makes contact, with narrow sides of the rail, with one of a longitudinal side surfaces that delimit the guide plate on the longitudinal sides of the rail, in a corner region, wherein in end segments of the guide surface that border on the corner region, a latch projection that projects away from the guide surface in the longitudinal direction of the guide plate is formed, which latch projection is intended for engaging, during use, under the longitudinal side of the rail that is assigned to the guide surface, wherein the guide surface has a greater width than the support surface, so in that a projection of the support surface into the guide surface, the guide surface projects laterally beyond the support surface with end segments of the guide surface in which the latch projections are formed, and that in the width direction of the guide plate, a distance between the latch projections amounts to at least 70% of the width of the guide surface, and wherein the latch projections have a slanted surface on a top side of the latch projections, on which a rail foot is supported and which drops in the direction of a free end face of the latch projections.

2. The guide plate according to claim 1, wherein for a ratio BF/BS of the width of the guide surface to the width of the support surface, the following applies: $1.2 \leq BF/BS \leq 1.6$.

3. The guide plate according to claim 1, wherein the underside of the latch projection meets with a lower delimitation edge of the end face of the guide plate that has the guide surface, and a height of the latch projections is at most equal to half a height of the guide surface.

4. The guide plate according to claim 3, wherein a slanted surface encloses an angle of at most 45° with a plumb line dropped to the guide surface.

5. The guide plate according to claim 4, wherein the latch projections extend over the width of the end segment of the guide surface.

6. The guide plate according to claim 1, wherein the latch projections border on the corner region assigned to them, in each instance, in which the guide surfaces make contact with a longitudinal side surface of the guide plate, in each instance.

7. The guide plate according to claim 1, wherein in an edge region of the top side bordering on the guide surface, a reinforcement rib is formed, which extends over the width of the guide surface.

8. The guide plate according to claim 7, wherein in edge regions of the top side of the guide plate bordering on the longitudinal side surfaces, a stiffening rib is formed, in each instance.

9. The guide plate according to claim 8, wherein the reinforcement rib makes a transition into one of the stiffening ribs at a lateral end of the reinforcement rib.

10. The guide plate according to claim 1, wherein when viewed in a top view of a top side of the guide plate, the top side is shaped with mirror symmetry with reference to a longitudinal axis.

11. A rail attachment point comprising a railroad tie that has a top side and two longitudinal sides, which come together with the top side of the railroad tie in a longitudinal edge, wherein a rail held in the rail attachment point is supported on a contact surface provided on the top side of the railroad tie, and wherein the railroad tie is oriented transverse to the rail and has a width measured in the direction of the longitudinal expanse of the rail, and a guide plate formed in accordance with claim 1, attached to the railroad tie, which plate is supported, by way of the guide plate support surface, on a shoulder provided on the railroad tie, and on the guide surface of which plate the rail is guided with one of the longitudinal sides of the rail, under which the latch projections engage.

12. The rail attachment point according to claim 11, wherein the width of the guide surface is at least equal to the width of the contact surface of the railroad tie, measured parallel to the longitudinal expanse of the rail.

13. The rail attachment point according to claim 11, wherein at least one intermediate plate is arranged between the rail and the railroad tie, by means of which plate the rail is held at a height distance above the contact surface of the railroad tie, which distance is at least equal to a height of the latch projections.

14. A guide plate for laterally guiding a rail in a rail attachment point formed on a railroad tie, wherein the guide plate possesses:

a top side, wherein a support surface for supporting a spring element is formed on, an underside, which the guide plate is supported on the railroad tie during use, a support segment, comprising a support surface on an end face of the support segment, wherein the guide plate is supported, during use, on a shoulder of the railroad tie, and a guide segment, the guide segment formed in the longitudinal direction of the guide plate, lying opposite the support segment, and on the end face of which a guide surface is present, on which a longitudinal side of the rail is supported during use, in order to guide the rail laterally, wherein the guide surface makes contact, with narrow sides of the rail, with one of the longitudinal side surfaces that delimit the guide plate on the longitudinal sides of the rail, in a corner region, wherein in end segments of the guide surface that border on the corner regions, a latch projection that projects away from the guide surface in the longitudinal direction of the guide plate is formed, which projection is intended for engaging, during use, under the longitudinal side of the rail that is assigned to the guide surface, and wherein the guide surface has a greater width than the support surface, so that a projection of the support surface into the guide surface, the guide surface projects laterally beyond the support surface with end segments of the guide surface in which the latch projections are formed, and that in the width direction of the guide plate, the distance between the latch projections amounts to at least 70% of the width of the guide surface wherein the underside of the latch projections meets with a lower delimitation edge of the end face of the guide plate that has the guide surface, and a height of the latch projections is at most equal to half a height of the guide surface, and wherein a slanted surface encloses an angle of at most 45° with a plumb line dropped to the guide surface.

* * * * *